United States Patent [19]

Otake et al.

[11] Patent Number: 5,026,236

[45] Date of Patent: Jun. 25, 1991

[54] PHOTOGRAPH BINDING APPARATUS

[75] Inventors: Katsumi Otake; Takekazu Yanagimoto; Shuichi Nakajima; Yuhei Kishimura, all of Tokyo, Japan

[73] Assignee: Fuji Photo Film Co., Ltd., Kanagawa, Japan

[21] Appl. No.: 521,865

[22] Filed: May 11, 1990

[30] Foreign Application Priority Data

May 11, 1989 [JP] Japan ..... 1-54040[U]
May 11, 1989 [JP] Japan ..... 1-117682
May 11, 1989 [JP] Japan ..... 1-117683

[51] Int. Cl.[5] ..... B42B 5/00

[52] U.S. Cl. ..... 412/33; 412/8; 412/21; 412/900

[58] Field of Search ..... 412/33, 8, 37, 29, 21, 412/900, 901, 18, 19, 22, 4, 5

[56] References Cited

U.S. PATENT DOCUMENTS 3,708,813 1/1973 Carter et al. ..... 412/21
3,825,963 7/1974 Abildgaard et al. ..... 412/21
3,825,964 7/1974 Groswith, III et al. ..... 412/21
3,954,548 5/1976 Polit ..... 412/900
4,150,453 4/1979 Vaughn ..... 412/900
4,496,617 1/1985 Parker ..... 412/900
4,511,297 4/1985 Wilson et al. ..... 412/8
4,540,458 9/1985 Baughman et al. ..... 412/8

FOREIGN PATENT DOCUMENTS 1536499 2/1970 Fed. Rep. of Germany ..... 412/900

*Primary Examiner*—Frank T. Yost
*Assistant Examiner*—Hwei-Siu Payer
*Attorney, Agent, or Firm*—Sughrue, Mion, Zinn, Macpeak & Seas

[57] ABSTRACT

In an apparatus for making a booklet or album formed of a plurality of photographs bound by a cover sheet, many photographs are inserted between a pair of nipping plates in an insertable situation and are held loosely in an upright state on a photograph receiving member. In the insertable situation, the receiving member is vibrated and the photographs are straightened at lower ends and one side edges. The straightened photographs are nipped by a pair of nipping plates from both sides and moved to a bonding position above an adhesive layer on the cover sheet. Thereafter, a pressure roller is rolled in the longitudinal direction of the adhesive layer to press the cover sheet upwardly in order to attach the lower ends of the phographs to the adhesive layer. This cover sheet is bent in a channel shape by a V-shaped groove formed on a bending block along a rim on each side of the photographs.

13 Claims, 9 Drawing Sheets

PHOTOGRAPH BINDING APPARATUS

BACKGROUND OF THE INVENTION

This invention relates to a photograph binding apparatus, and more particularly to an apparatus which is used for making a booklet or album.

Heretofore, in a store offering photoprinting services, the usual practice of the staff working in the store has been to hand over to their customers a number of photographs, which were made from one negative film, in an individually separated form. Such individual photographs can become scattered, or even lost, before being placed in an orderly fashion in an album or the like. Because of this problem, some photoprinting service stores have worked out a way of preparing a handy type album, formed of one set of mount sheets having many pockets formed thereon, by attaching a transparent cover to each mount sheet for keeping one photograph in each pocket. Thus, the stores can hand over to their customers this handy album with photographs in it.

To save time and labor to insert one photograph in each pocket, the present applicant has proposed a new apparatus for making a booklet or album formed by attaching one side of a bundle of photographs to a cover sheet, and already has filed a patent application in the Japanese Patent Office relating to this invention (the application has not been published yet).

However, the just-mentioned apparatus uses a hot melt type bonding agent, and so it is necessary to apply heat in order to melt the bonding agent. Therefore, the apparatus is provided with a heating device to set the heating temperature to a desired level in order to obtain a melting temperature. As a result, the construction of the apparatus becomes complicated and operation of the apparatus requires increased consumption of electric power. Moreover, as the hot melt type melting agent lacks elasticity, another problem arises in that photographs held in the booklet or album are difficult to turn over.

Also, in the known apparatus, when photographs of one customer's order are arranged into one group, the lower ends of the photographs are straightened and then are abutted against the surface of a hot melt type adhesive layer coated on the cover sheet. Then, one side edge of each of the photographs is pressed against a back guide plate so as to be straightened. As photographs are straightened by hand in this way, it is difficult to bind the photographs efficiently. Moreover, when a booklet or album is made using the abovementioned apparatus, first a plurality of photographs are attached to the cover sheet in a vertically erect posture, and then the cover sheet is bent in a channel shape to form a front cover portion, a back cover portion, and a rear cover portion. Because that bending is performed by hand, it has been practically impossible to bend the cover sheet attractively.

SUMMARY OF THE INVENTION

In view of the foregoing, it is a principal object of the present invention to provide a safe photograph binding apparatus which uses no heater.

Another object of the invention is to provide a photograph binding apparatus for making a booklet or album whose pages are easy to turn over.

A further object of the invention is to provide a photograph binding apparatus, in which a cover sheet can be bent with ease.

In order to achieve the foregoing and other objects and advantages, the inventive photograph binding apparatus includes a stage, on which there is placed a cover sheet having a strip-shaped adhesive layer formed in a back sheet portion of the cover sheet, the stage having an opening larger than the adhesive layer, the opening being formed in a position where said adhesive layer is located. The inventive apparatus also includes nipping apparatus, including a pair of plates, and displaceable between an insertable situation and a nipping situation. In the insertable situation, the nipping apparatus permits a number of photographs to be inserted between the pair of plates. In the nipping situation, the nipping apparatus nips the photographs from both sides thereof with lower ends of the photographs protruding downwardly below the lower ends of said plates.

The inventive binding apparatus further includes a movement device for moving the photograph nipping apparatus between a loading position, in which the photographs are loaded, and a bonding position disposed above the opening. The inventive binding apparatus further includes structure for receiving the lower ends and one side edge of the photographs so that the inserted photographs are not dropped when the nipping apparatus is in the bonding position.

The binding apparatus still further includes a pressure roller, movable along the opening and protruding from the opening. When the photograph nipping apparatus is in its bonding position, the roller pressurizes the cover sheet from a back thereof in order to bond the adhesive layer to the lower ends of the photographs.

A preferred embodiment of the invention also employs a vibration device for vibrating the photograph receiving structure in order to straighten a plurality of photographs when the photograph nipping apparatus is in the insertable position. This vibration device includes in turn a motor, mounted on the photograph receiving structure, and an eccentric member eccentrically mounted on a shaft of the motor. Similarly, the photograph nipping apparatus includes a base nipping plate and a movable nipping plate, able to approach and retreat from the base nipping plate.

The photograph receiving structure includes a bottom plate which contacts the lower ends of the photographs, a front plate which contacts either right or left sides of the photographs, and a mounting plate, integrally mounted on either right or left side portion of the bottom plate or the front plate. An isobutyleneisoprene rubber type, which has resiliency and adhesion at a normal temperature, can be used as a bonding agent.

The cover sheet can be bent attractively in a channel shape by using a cover sheet bending block. This cover sheet bending block includes a block body, and a groove formed on this block body and having a generally V-shaped cross-section. The width of the groove is greater than the maximum thickness of a bundle of photographs.

According to the invention, when the photograph nipping apparatus is in the loading or straightening position, the photograph receiving device is vibrated in order to straighten the photographs at ends and side edges thereof. Accordingly, the ends and side edges of the photographs can be straightened rapidly without manual effort. Moreover, after being straightened, the photographs can be moved to the bonding position in a posture in which they are nipped by the photograph nipping apparatus. Accordingly, the ends and side edges of the photographs are not disorderly, and the photographs can be bonded directly to the cover sheet.

Further, an opening is formed in a part of the stage where the adhesive layer of the cover sheet is present so that the pressure roller can be moved with a part thereof protruding upwardly from the opening, and can pressurize the cover sheet against the lower ends of the photographs. Accordingly, it is no longer required to use a heater for heating a hot melt type bonding agent. Accordingly, construction becomes simpler, and binding can be performed safely.

Still further, the invention uses an adhesive bonding agent of an isobutylene-isoprene rubber type. Accordingly, the photographs can be turned over with ease. Moreover, a V-shaped groove is formed on the block body, and the cover sheet with a bundle of photographs bonded thereto are inserted into the V-shaped groove so that the cover sheet is hazed at the portion where the photographs are bonded by the surface or the edges of the groove. Accordingly, the cover sheet can be bent attractively with ease.

Besides, as the front cover portion and the back cover portion can be bent all at once by a single bending operation, working efficiency is improved. In addition, since the groove is formed in a V-shape, even if the thickness of the bundle of photographs is changed, the portion of the cover sheet where the photographs are bonded can be abutted properly against the surface or the edges of the groove and the cover sheet can be bent correctly.

BRIEF DESCRIPTION OF THE DRAWINGS

The above and other objects and features of the invention will become manifest upon reading of the detailed description of the present invention with reference to the accompanying drawings, wherein.

DETAILED DESCRIPTION OF THE PREFERRED EMBODIMENT

Figure 1:
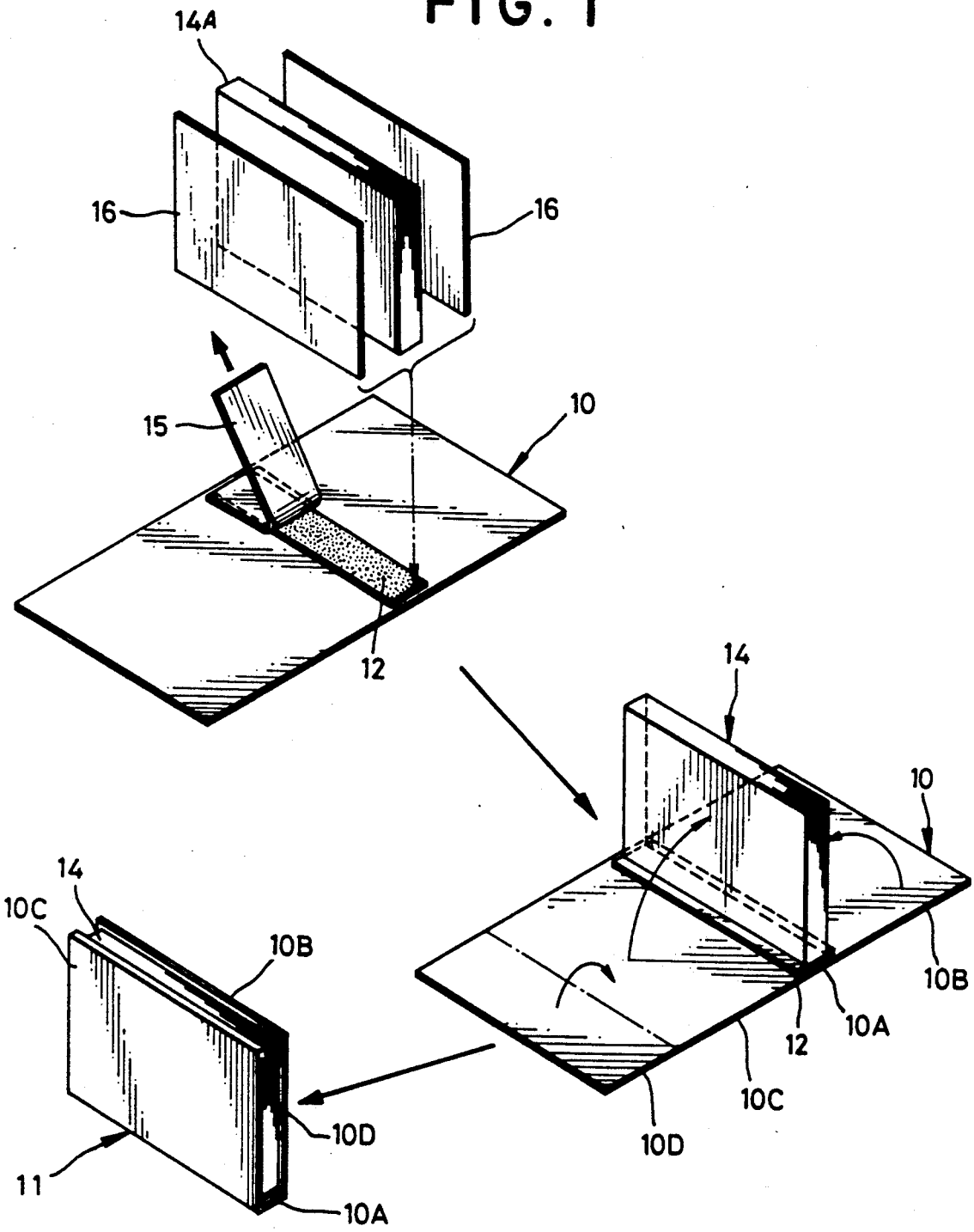
FIG. 1 is a schematic view for explaining the steps for making a booklet or album.

In FIG. 1, showing the steps for making a booklet or album 11, a cover sheet 10 made of a comparatively thick paper has an adhesive layer 12 formed at a central portion on a rear surface thereof and extending in the width direction thereof. The cover sheet 10 has pictures, characters, etc. printed on its surface as needed. The central position having the adhesive layer 12 will be turned out to a back cover portion 10A when the booklet album 11 is set up. The width of the adhesive layer 12 is slightly greater than the thickness of a bundle of maximum number of photographs.

An isobutylene-isoprene rubber type bonding agent is used in the adhesive layer 12. The thickness of the bonding agent coated on the adhesive layer 12 is in a range from 0.1 to 1.5 mm and preferably 0.5 mm. Because an isobutylene-isoprene rubber type bonding agent is elastic and adhesive at room temperature, even if the photographs 14 are bound in a booklet, the photographs 14 can be turned over with ease. The bonding agent used in this embodiment has just enough adhesive strength for the photographs 14 to be peeled off the album 11 individually, after the photographs 14 are bonded to the cover sheet.

Also, the adhesive layer 12 has a peelable paper 15 applied thereto in order to prevent the cover sheet 10 from being partly bonded together through the adhesive layer 12 when a number of cover sheets 10 are stacked up. As a result, the cover sheet 10 becomes easy to handle. Furthermore, at least a piece of memo paper 16 is superposed on both front and rear sides of the bundle of photographs 14, respectively. This memo paper 16 is adapted to serve not only as a place to write something when the cover sheet 10 is set up as an album, but also as a way of preventing excessive adhesive in the layer 12 from sticking to the fronts and backs of the photographs 14.

When the lower ends 14A of the bundle of photographs 14 have been bonded to the adhesive layer 12 of the cover sheet 10, the cover sheet 10 is bent in such a manner as to form a front cover portion 10B, a back cover portion 10A, and a rear cover portion 10C, thus completing the process of making the booklet. It is noted that rear cover portion 10C is wider than the front cover portion 10B in this embodiment. An extra portion 10D of this rear cover 10C is bent inwardly so that the rear cover portion 10C has the same width as the front cover portion 10B when the photographs 14 are bound. In this way, after the photographs 14 are bonded to the cover sheet 10, the rear cover 10C is bent in such a manner as to match the width of the front cover 10B. Accordingly, even when the thickness of the album is changed owing to a change in the total number of photographs 14, the width of the rear cover portion 10C can be kept always the same as the width of the front cover portion 10B.

Figure 2:
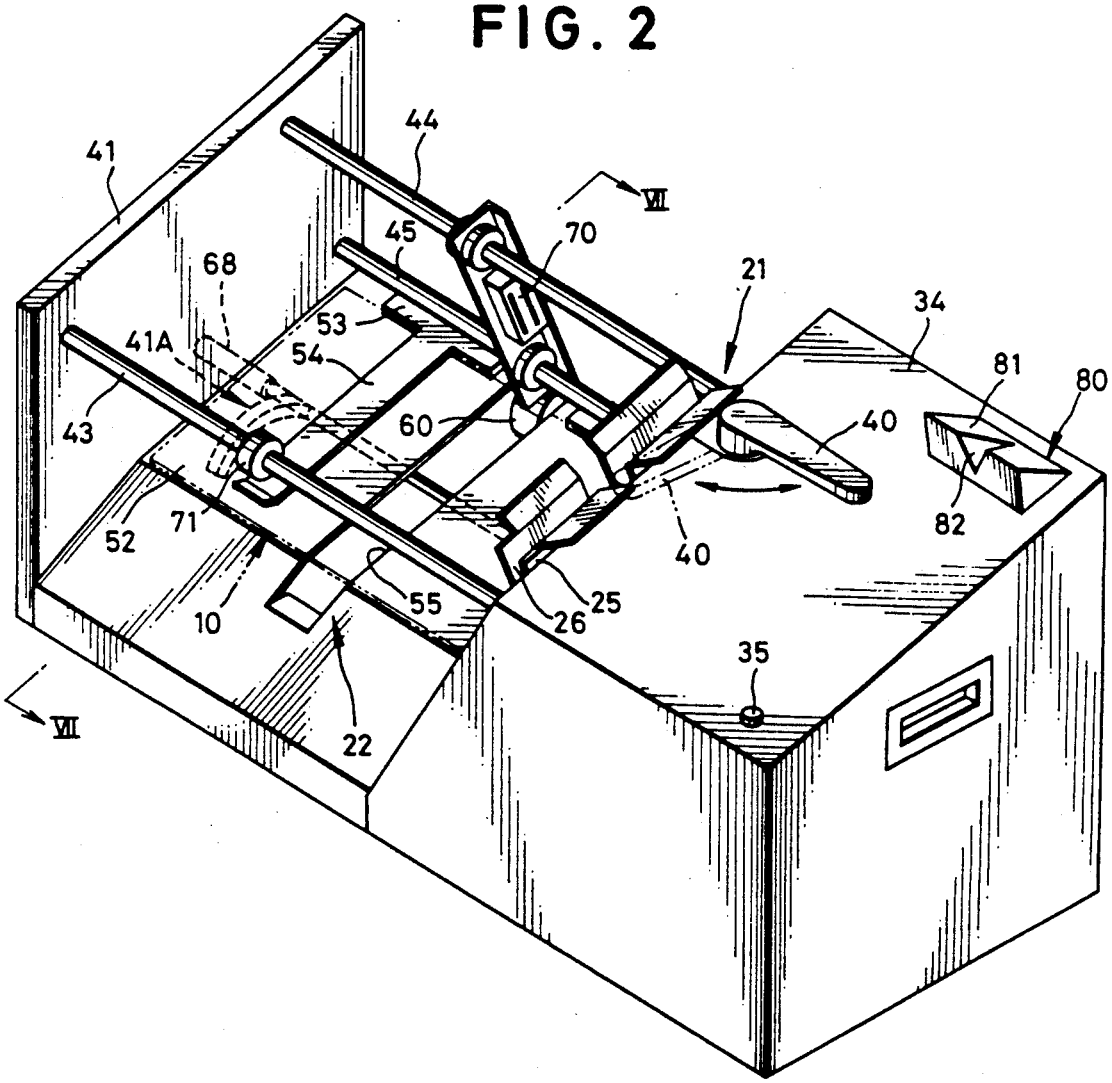
FIG. 2 is a perspective view of the embodiment of the inventive photograph binding apparatus.
Figure 3:
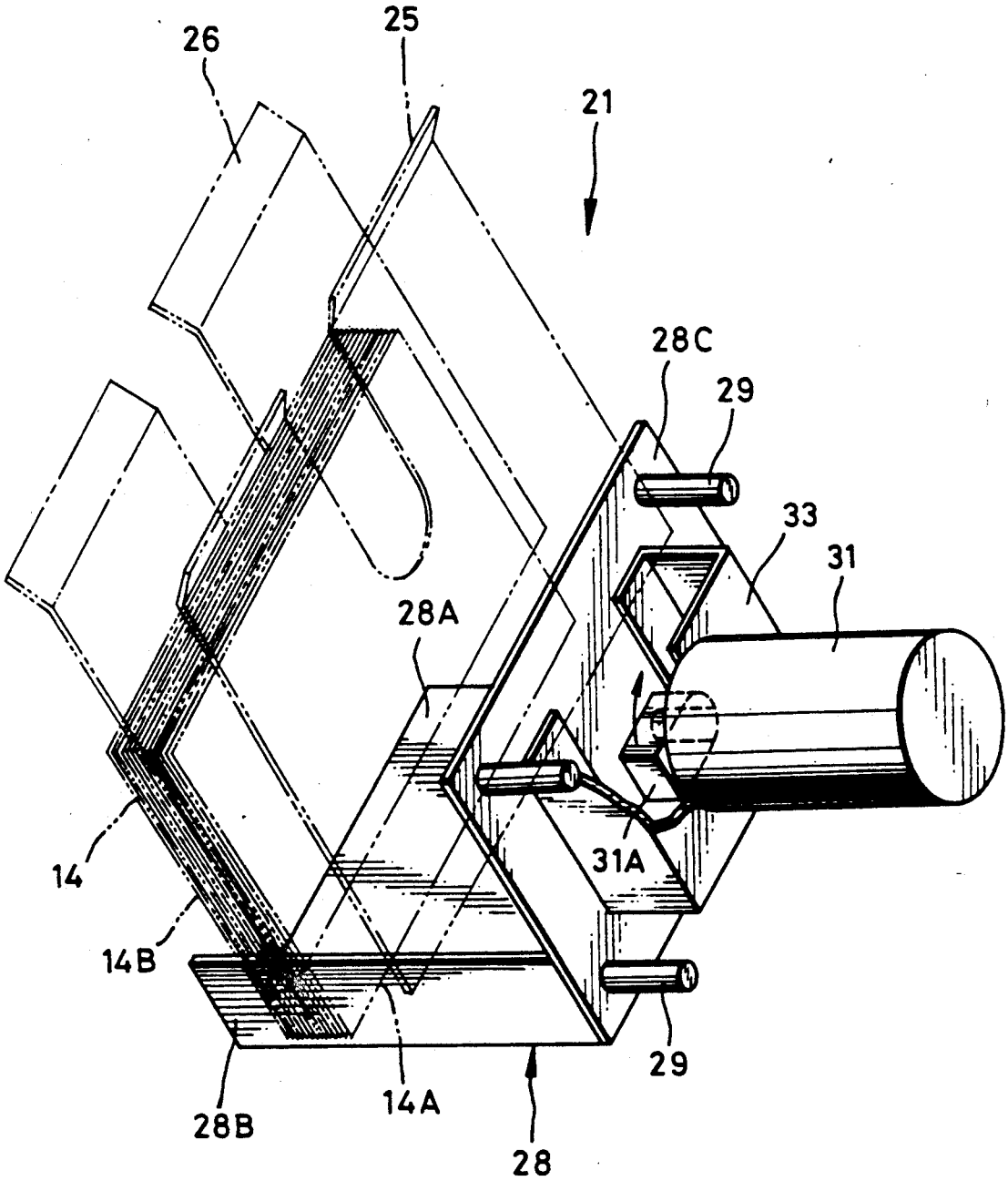
FIG. 3 is a perspective view of a mechanism for straightening the ends and side edges of photographs.

The photograph binding apparatus of FIG. 2 includes a photograph end-and-side straightening mechanism 21, a cover sheet bonding mechanism 22, and a cover sheet bending block 80. The photograph end-and-side straightening mechanism 21, as shown in FIG. 3, holds a plurality of photographs 14, which all are upright, by supporting the bundle of photographs 14 from both sides thereof through a pair of nipping plates 25, 26 and receiving the downwardly protruded portions of the photographs 14 in a photograph receiving tray 28. Then, the photograph receiving tray 28 is vibrated in a direction perpendicular to the nipping plates 25, 26. By this vibration, the photographs 14 are gathered to one corner of the photograph receiving tray 28 in order to straighten the lower ends 14A, and the right and left sides 14B are straightened.

The photograph receiving tray 28 includes a bottom plate 28A, against which the lower ends 14A of the photographs 14 are abutted, and a front plate 28B, against which one side of the photographs 14 are abutted, and which is formed overall in an L-shape. The bottom plate 28A is provided with a mounting plate 28C extending upwardly at right angles from one side thereof. The mounting plate 28C is provided with a motor 31 mounted on its center through a mounting framework 33. The motor 31 has an eccentric block 31A mounted on its drive shaft in an eccentric state. When the motor 31 is actuated by a motor start button 35 (FIG. 2), it causes the eccentric block 31A to rotate. The motor 31 is vibrated by reaction of the rotation of the eccentric block 31A, and the photograph receiving tray 28 is also vibrated together with the motor 31.

The photograph receiving tray 28 is mounted on a frame plate 30 (see FIG. 5) through an elastic mounting shaft 29 made of rubber material, such that the bottom plate 28A is lowered at its front portion and the photograph receiving tray 28 is inclined with respect to a horizontal plane. In this way, as the photograph receiving tray 28 is mounted by the elastic rubber mounting shaft 29, the photograph receiving tray 28 is vibrated readily when the motor 31 is rotated. Furthermore, because the photograph receiving tray 28 is mounted in its inclined state with a front portion thereof lowered, the photographs in the receiving tray 28 are moved in the inclined direction of the bottom plate 28A and the front plate 28B when the receiving tray 28 is vibrated. As a consequence, the ends and side edges of the photographs 14 are straightened without fail.

Figure 4:
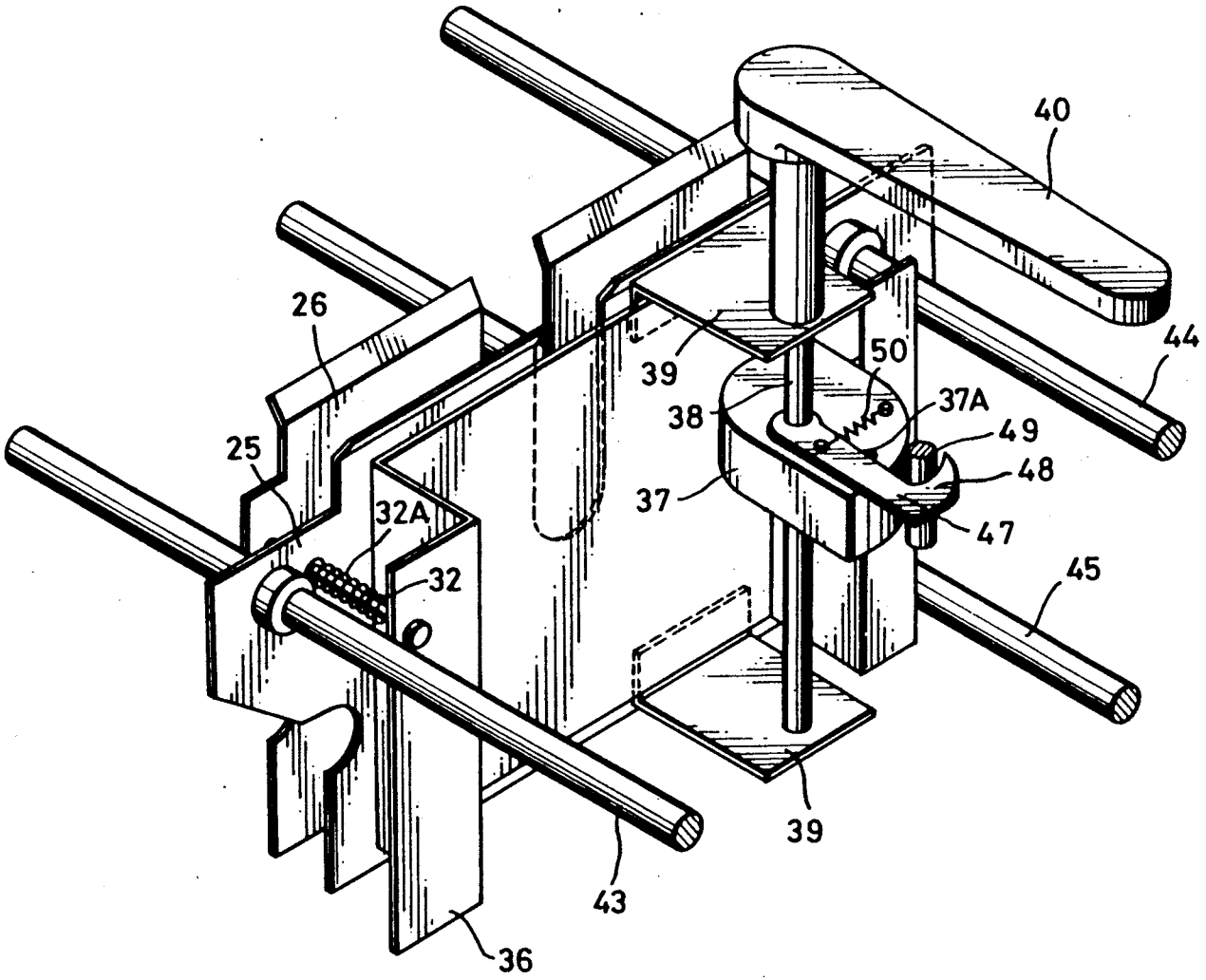
FIG. 4 is a perspective view of a photograph nipping mechanism.
Figure 5:
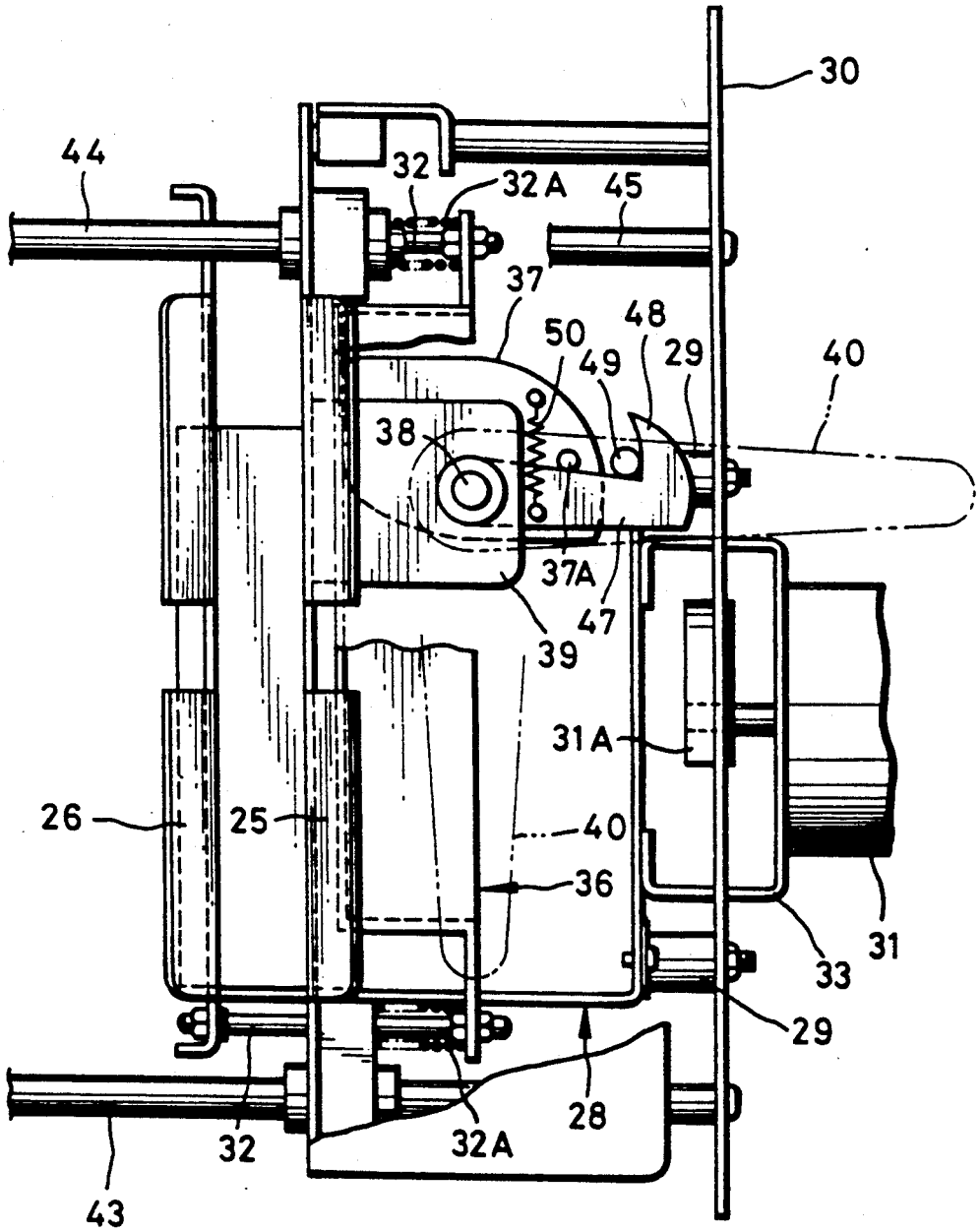
FIG. 5 is a plan view of the photograph nipping mechanism which is set in an insertable state.
Figure 6:
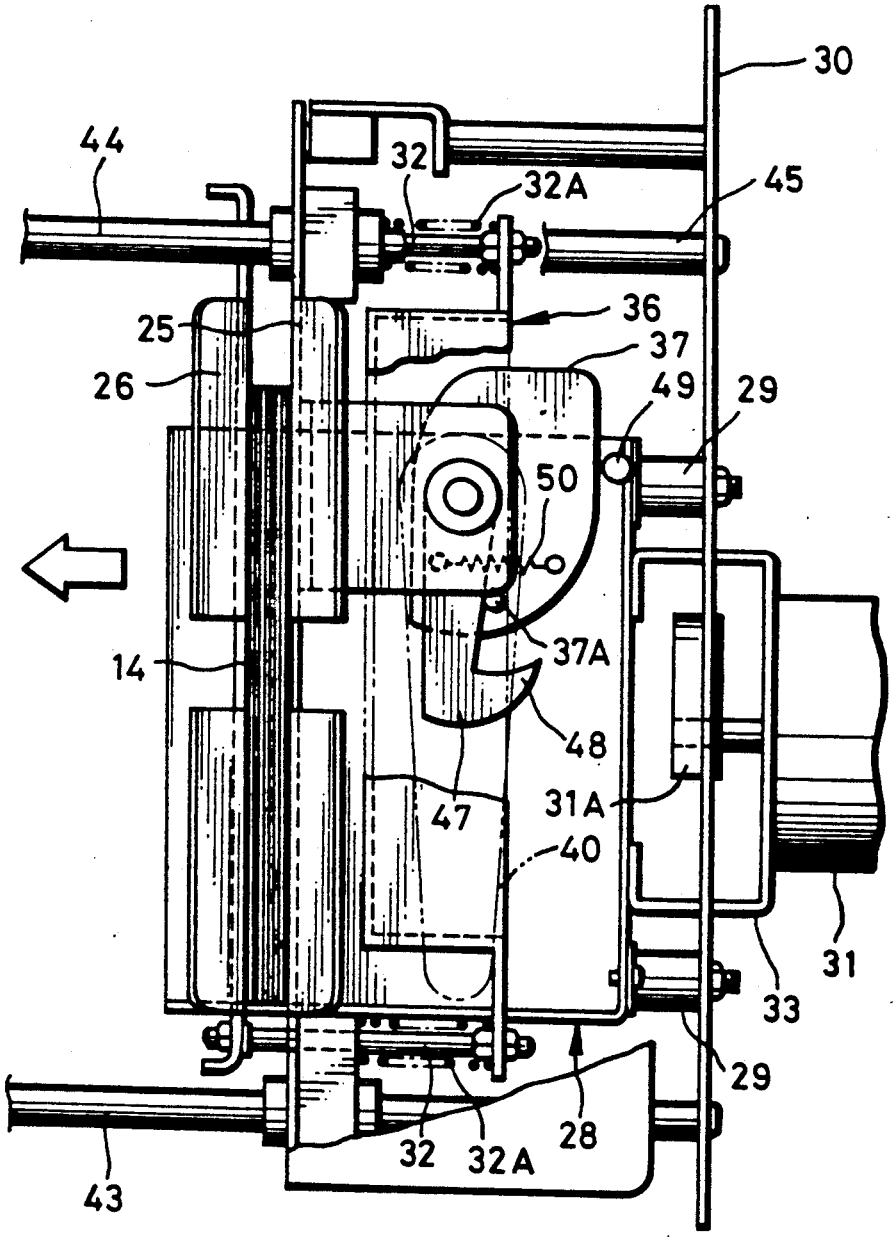
FIG. 6 is a plan view of the photograph nipping mechanism which is set in a nipping state.

A pair of nipping plates 25, 26 are arranged on the bottom plate 28A of the photograph receiving tray 28 and extending upwardly therefrom. As is shown in FIGS. 4, 5, and 6, one of the pair of nipping plates, i.e., plate 25 is a base plate, and the other plate 26 is a movable plate. When the movable nipping plate 26 is moved away from the base nipping plate 25, an insertable (or open) situation is realized. In this insertable situation, the bundle of photographs 14 are inserted between the nipping plates 25, 26 on the photograph receiving tray 28. Also, in this situation the nipping plates 25, 26 merely hold the photographs 14 so that the photographs 14 do not fall in the photograph receiving tray 28. Each photograph 14 is permitted to move on the tray 28 a little, and each end and side edge of the photographs 14 are straightened by vibration of the tray 28.

On the other hand, when the movable nipping plate 26 approaches the base nipping plate 25, a nipped (or close) situation is realized. In this closed situation, the already straightened photographs 14 are nipped by and between the nipping plates 25, 26. In this way, in order to open and close the nipping plates 25, 26, the movable nipping plate 26 is fixed to one end of a guide bar 32 being slidably mounted on the base nipping plate 25. The guide bar 32 has an engaging plate 36 secured to a front end of the guide bar 32. Between the base nipping plate 25 and the engaging plate 36, a coil spring 32A is disposed in a biased state. The coil spring 32A is adapted to urge the movable nipping plate 26 in the closing direction, i.e., the movable nipping plate 26 is caused to approach to the base nipping plate 25.

The engaging plate 36 engages a cam 37 which is mounted on the base nipping plate 25 through a mounting shaft 38 and a bracket 39. The mounting shaft 38 is provided with an operating lever 40 fixed to an upper end thereof. By rotating this operating lever 40 by 90°, the cam 37 is displaced between a pushing and a non-pushing position. As shown in FIG. 4, when the operating lever 40 is parallel to guide bars 43, 44 of the base nipping plate 25, the cam 37 is moved to the pushing position. In this pushing position, as shown in FIG. 5, the engaging plate 36 is pushed by the cam 37 against the urging force of the coil spring 32A, and the movable nipping plate 26 is brought into an open situation in which the movable nipping plate 26 is spaced apart from the nipping plate 25.

Likewise, when the control lever 40 is set at an angle with respect to the guide bars 43, 44, the cam 37 is brought to a non-pushing position. In this non-pushing position, the cam 37 does not push the engaging plate 36, and the movable nipping plate 26 is pushed against the base nipping plate 25 by the urging force of the coil spring 32A, thus realizing the photograph nipping situation.

The base nipping plate 25 is movable in the lateral direction within a body of this apparatus owing to three guide bars 43, 44, and 45 stretched between frame plates 30, 41 and selectively set in a loading or a photograph straightening position above the receiving tray 28 or in a photograph bonding position above a stage 52 on which the cover sheet 10 is placed. As shown in FIG. 4, a lock lever 47 is mounted swingably on a mounting shaft 38 on the cam 37 and adapted to lock the nipping plate 25 in the photograph straightening position so that the nipping plate 25 is not slid by vibration of the receiving tray 28. This lock lever 47 is urged by a spring 50 so that a hook 48 is retained by a fixed pin 49. The fixed pin 49 is mounted on the frame plate 30.

The cam 37 is provided with a stopper pin 37A for restricting the swinging motion of the lock lever 47. Therefore, when the cam 37 is set to the non-pushing position from the pushing position by rotating the operating lever 40 clockwise in the drawing by 90°, the lock lever 47 is also rotated clockwise by the stopper pin 37A. As a result, the retention of the lock lever 47 is cancelled, as shown in FIG. 6, and the base nipping plate 25 is permitted to move in the direction of the guide rod.

At the same time, as mentioned above, since the engagement plate 36 is no longer pushed by the cam 37, and the movable nipping plate 26 is moved by the urging force of the coil spring 32A and comes to nip the bundle of photographs 14 together with the base nipping plate 25. In this way, when the lock lever 47 is unlocked and the nipping plates 25, 26 are permitted to move, the nipping plates 25, 26 are brought into the nipping state. As a result, the photographs 14 are nipped by and between the nipping plates 25, 26 without fail when the nipping plates 25, 26 are moved. Thereafter, when the operating lever 40 is moved in the left-hand direction in FIG. 2, the base nipping plate 25 is abutted against a permanent magnet 70 and a stopper 71.

As a result, the photographs 14 are set from the side straightening position above the receiving tray 28 to the bonding position above the stage 52 of the cover sheet bonding mechanism 22. Owing to the attraction of the permanent magnet 70, the base nipping plate 25 is fixed at the bonding position so that the plate 25 is not moved therefrom.

Figure 7:
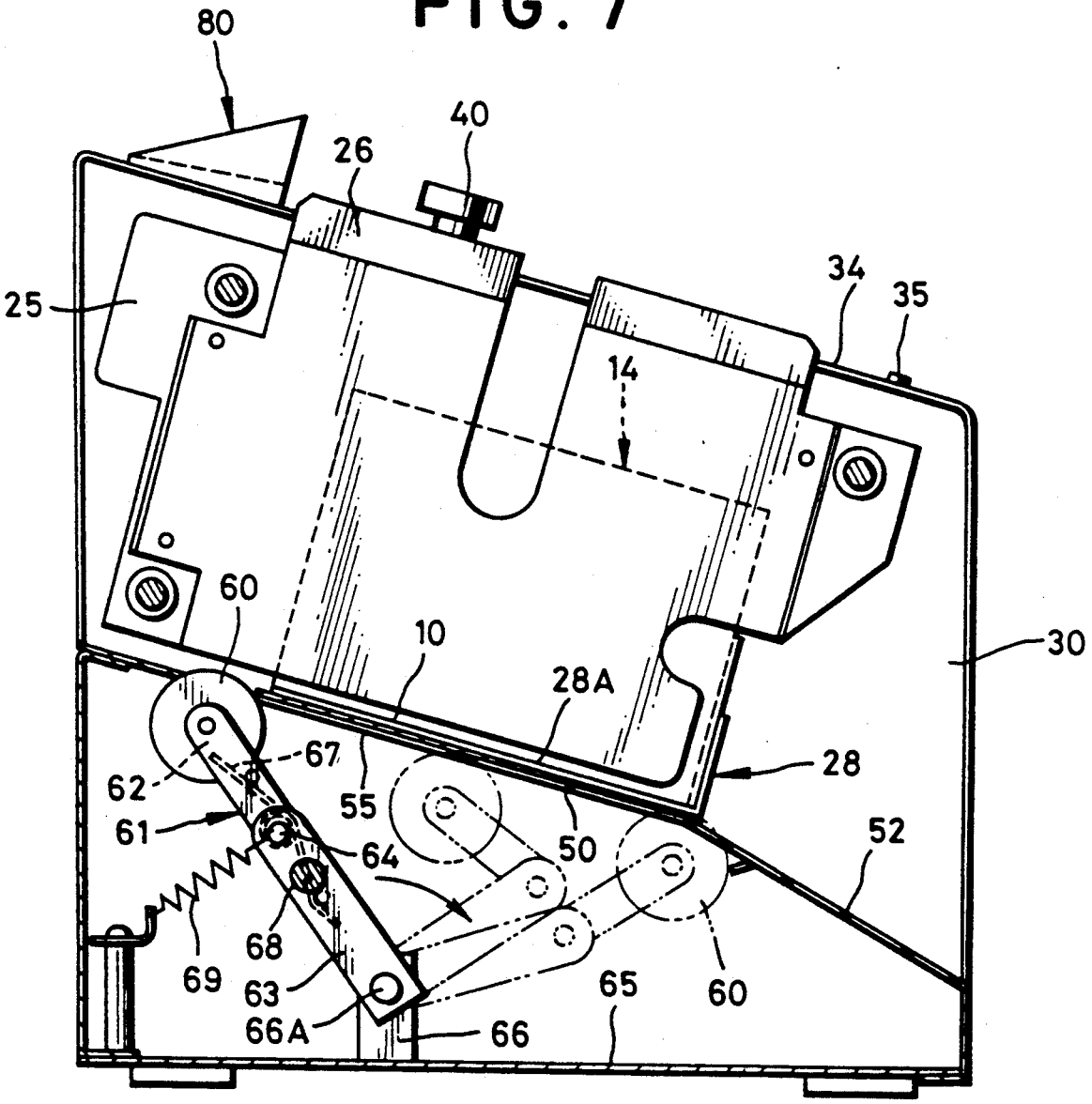
FIG. 7 is a sectional view, taken on line VII—VII of FIG. 2, of a cover sheet bonding mechanism.

The cover sheet bonding mechanism 22 is constructed as follows. As shown in FIGS. 2 and 7, the stage 52 for placing the cover sheet 10 thereon is parallel to the bottom plate 28A of the photograph receiving tray 28 of the photograph end-and-side straightening mechanism 21, and is in a position slightly lower than the bottom plate 28A. The arrangement is such that the bundle of photographs 14, having lower ends 14A already straightened by the bottom plate 28A of the photograph receiving tray 28, can be moved in parallel relation on the stage 52. In this way, as the stage 52 is mounted in the state where the front portion thereof is lowered and inclined, when the nipping plates 25, 26 are opened, the cover sheet 10 with the photographs 14 already bonded thereon is slid this way. Therefore, the cover sheet 10 and the photographs 14 can be taken out of the stage 52 with ease. Also, there is provided an upper guide plate 53 against which the upper side of the cover sheet 10 is to be abutted. By abutting the upper side of the cover sheet 10 against the guide plate 53, the cover sheet 10 is correctly positioned on the stage 52. Furthermore, as shown in FIG. 2, the upper guide plate 53 is provided with a clip plate 54 mounted thereon so as to be parallel to the stage 52. The clip plate 54 clamps the cover sheet 10 together with the stage 52.

The stage 52 has an opening 55 formed in a central portion thereof, where the adhesive layer 12 of the cover sheet 10 is positioned. A pressure roller 60 is disposed within the opening 55. The pressure roller 60 is adapted to pressurize the cover sheet 10 against the photographs nipped by and between the nipping plates 25, 26 so that the adhesive layer 12 of the cover sheet 10 is bonded to the lower ends 14A of the photographs 14. The pressure roller 60 is mounted rotatably on an upper end portion of a link 61 which can be bent generally in a V-shape.

The link 61 is formed of a pair of arms 62, 63 interconnected pivotally by a pivot shaft 64. A lower end portion of the link 61 is attached pivotably to a bottom plate 65 of the apparatus body by a mounting shaft 66A through a bracket 66. The pivot shaft 64 is provided with a torsion spring 67 for urging the pressure roller 60 against the cover sheet 10. The lower arm 63 is provided with a swinging lever 68 mounted thereon in the horizontal direction.

A front end of the swinging lever 68, as shown in FIG. 2, is projected outside from an arcuate cut-out 41A. When the operator pulls the front end portion of the swinging lever 68 this way, the pressure roller 60 is rolled in the longitudinal direction of the adhesive layer 12 through the link 61. At this time, as the adhesive layer 12 is urged against the lower end 14A of the photograph 14 by the pressure roller 60 energized upward by the torsion spring 67, the photographs 14 are bonded to the cover sheet 10. The pivot shaft 64 is provided with a coil spring 69 adapted to restore the pressure roller 60 to its initial position.

Figure 8:
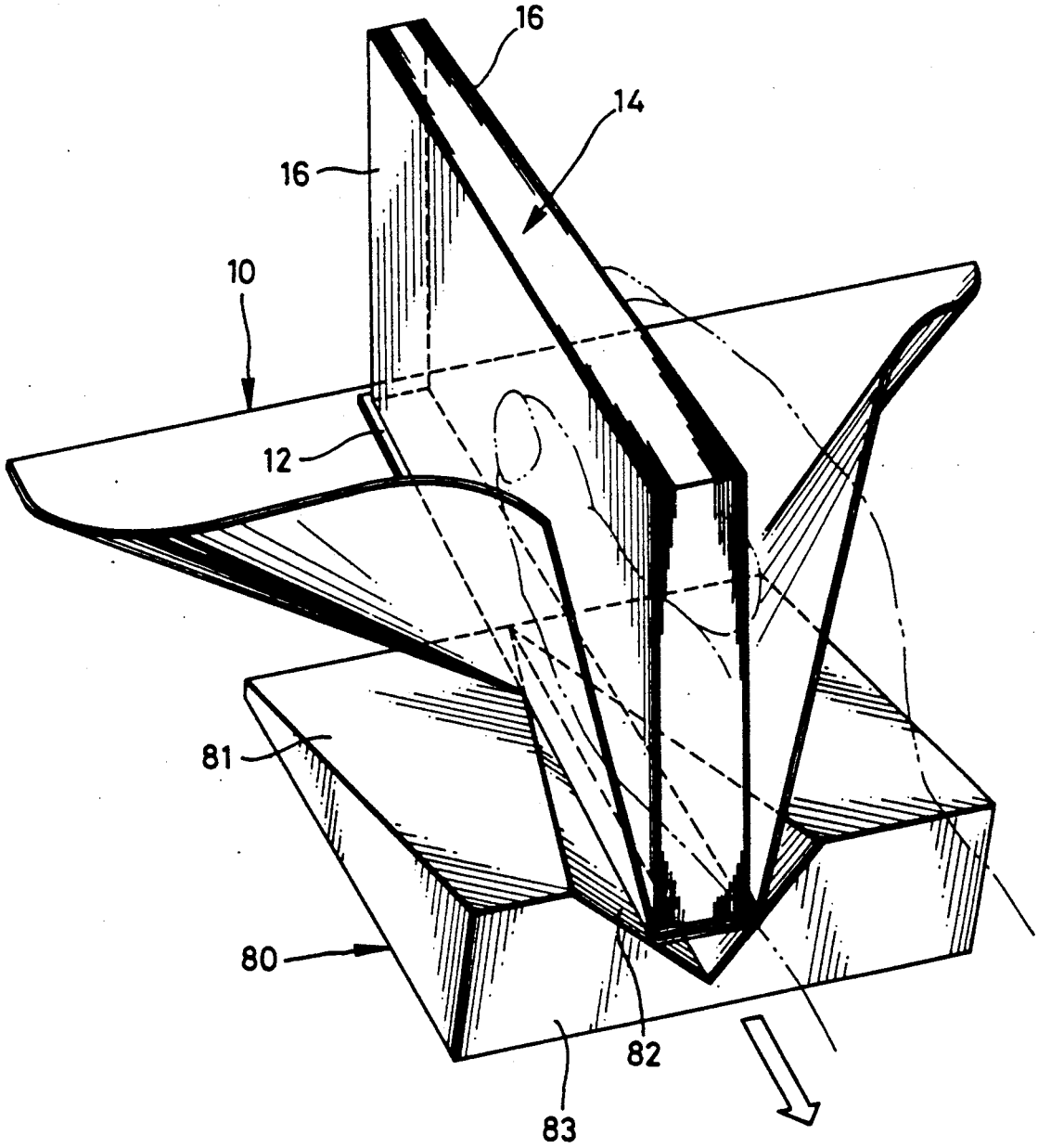
FIG. 8 is an explanatory view of bending of the cover sheet to form a front cover portion and a back cover portion using a cover sheet bending block.
Figure 9:
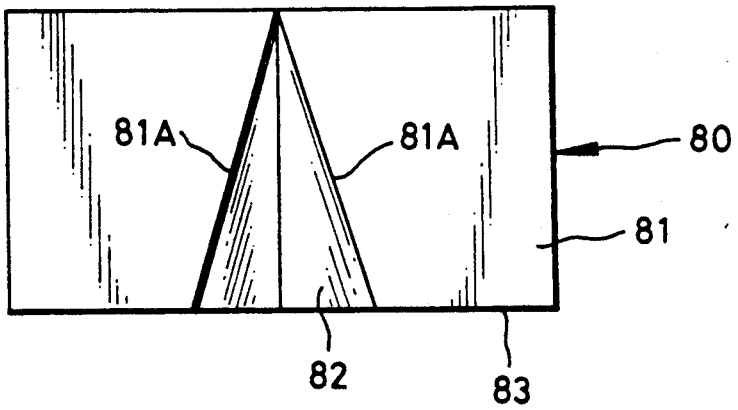
FIG. 9 is a plan view of the cover sheet bending block.
Figure 10:
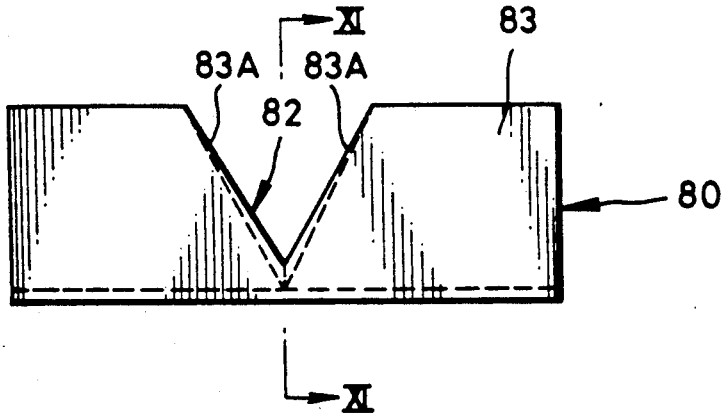
FIG. 10 is a front view of the cover sheet bending block.
Figure 11:
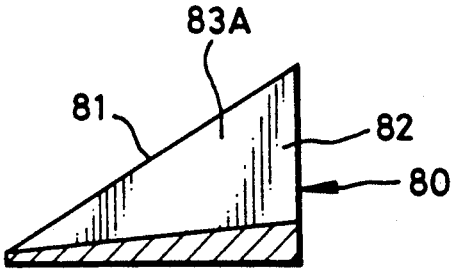
FIG. 11 is a sectional view taken on line XI—XI of FIG. 10.

Also, as shown in FIG. 2, an outer cover 34 has a cover sheet bending block 80 secured to an upper surface thereof. The cover sheet bending block 80 is adapted to bend the cover sheet 10 with the photographs 14 bonded thereto in order to form the front cover portion 10B, and the rear cover portion 10C. This bending block 80, as shown in FIGS. 8, 9, 10, and 11, is formed in a triangular pole shape having a right-angle triangle shape in section. The bending block 80 also has a generally V-shaped groove 82 formed in the center of an inclined surface portion 81 and of a front surface portion 83 thereof. In this way, as the V-shaped groove 82 is formed in an angular portion of the triangle pole, V-shaped groove edges 81A, 83A, when viewed from the front surface, are formed in the inclined surface portion 81 and the front surface portion 83. As a consequence, as shown in FIG. 8, by inserting the photograph bonded portion of the cover sheet 10 into the groove 82 and hazing the photograph bonded portion with the surface of the groove 82, the cover sheet 10 is bent linearly at the memo paper bonded portion of the photographs 14. In this way, the booklet or album 11 can be made with ease as shown in FIG. 1.

Next, operation of the above apparatus will be described. In the initial situation, as shown in FIG. 5, the pair of nipping plates 25, 26 are set in an insertable situation and are in a straightening position located above the photograph receiving tray 28. In this initial situation, as the lock lever 47 is retained by the fixed pin 49, the pair of nipping plates 25, 26 are not moved from the straightening position, even if the photograph receiving tray 28 is vibrated. In this initial situation, first, as shown in FIG. 1, the peelable paper 15 is peeled off and the adhesive layer 12 is exposed on the cover sheet 10. Then, such cover sheet 10 with the exposed adhesive layer 12 is set on the stage 52. This cover sheet 10 is held by the clip plate 54 so as not to move on the stage 52.

Next, a large number of photographs 14, bundled per a customer's order, are inserted between the nipping plates 25, 26 which are in an insertable situation. Such inserted photographs 14 are held upright by the nipping plates 25, 26 on the photograph receiving tray 28, with lower parts thereof protruded downward from the lower ends of the nipping plates 25, 26. When the motor start button 35 is operated, the motor 31 is energized for a predetermined time in order to rotate the eccentric block 31A. By reaction of the rotation of this eccentric block 31A, the motor 31 is vibrated, together with the photograph receiving tray 28. Owing to the vibration, each photograph 14 is slipped on the bottom plate 28A down to the front plate 28B side by dead weight, and the front sides 14B of the individual photographs 14 are abutted against the front plate 28B and straightened. At the same time, the lower ends 14A also are straightened by the bottom plate 28A.

After confirming that the respective ends and side edges of the photographs 14 have been straightened, the operator rotates the operating lever 40 clockwise by 90°. Then, as shown in FIG. 6, the nipping plates 25, 26 are brought to the nipping situation, in which the straightened photographs 14 are nipped from both sides by the nipping plates 25, 26. As the retaining of the lock lever 47 is cancelled by rotation of the cam 37, the base nipping plate 25 becomes movable. Then, the lock lever 47 is pushed manually to the bonding position where the base nipping plate 25 is brought into abutment with the permanent magnet 70 and the stopper 71. Owing to this movement, the photographs 14 can be set to a position above the adhesive layer 12 of the cover sheet 10.

Next, as shown in FIG. 7, when the swinging lever 68 is pulled this side, the pressure roller 60 moves along the opening 55 with an upper part of the roller 60 protruding upwardly from the opening 55. Owing to the movement of the pressure roller 60, the cover sheet 10 under the adhesive layer 12 is pushed upward to attach intimately the adhesive layer 12 to the lower ends 14A of the photographs 14. The lower end portions 14A of the photographs 14 are mutually bonded together by the adhesive layer 12 and are attached to the cover sheet 10. When the hand is removed from the swinging lever 68 after the lever 68 is pulled this side, the pressure roller 60 is returned to its original position by the coil spring 69.

On the way back to the original position, as the pressure roller 60 also pushes the cover sheet 10 upwardly, the photographs can be attached more intimately to the cover sheet 10. Then, the operating lever 40 is rotated counterclockwise by 90° to open the nipping plates 25, 26 to release the photographs 14, and the photographs 14, bonded to the cover sheet 10, are taken from the stage 52. After taking out the photographs, when the nipping plate 25 is moved to the right-hand side in the drawing by holding the operating lever 40 by hand, the lock lever 47 is retained by the fixed pin 49. As a result, the nipping plates 25, 26 are returned to their initial positions. By repeating the same procedure, a bundle of straightened photographs can be bonded to the cover sheet.

The cover sheet 10, with the photographs 14 attached thereon, as shown in FIG. 8, is hazed at a portion where the lower end of the memo paper 16 is attached by the groove edges 81A, 83A, or the groove surface of the bending block 80. As a result, the cover sheet 10 can be bent attractively into a channel shape at this position. After this bending, the excessive portion 10D of the back cover portion 10C is bent inwardly to complete the booklet or album 11 as shown in FIG. 1. It is noted that this excessive portion 10D may be omitted. Also, the cover sheet 10 may be set onto the stage 52 after all the ends and side edges of the photographs 14 are straightened. In this case, there is no fear that the cover sheet 10 will be displaced from the regular position on the stage 52 by vibration at the time when the ends and side edges of the photographs 14 are straightened.

In the above embodiment, the vibration device for applying vibration to the photograph receiving tray 28 was the eccentric block 31A eccentrically mounted on the drive shaft of the motor 31. However, the photograph receiving tray 28 may be vibrated of course by other suitable vibration devices. Also, in the above embodiment, the V-shaped groove 82 was formed on the block 80 formed of a triangle pole. However, the V-shaped groove may be formed on other cylindrical members and rectangular parallelopiped members. Furthermore, the depth of the groove may be uniform rather than being gradually reduced.

While the invention has been described in detail above with reference to a preferred embodiment, various modifications within the scope and spirit of the invention will be apparent to people of working skill in this technological field. Thus, the invention should be considered as limited only by the scope of the appended claims.

What is claimed is:

1. An apparatus for making a booklet or album of a plurality of photographs, said apparatus comprising:

photograph nipping means having a pair of nipping plates, for nipping together said plurality of photographs, said pair of photograph nipping plates being displaced between a nipping situation and an insertable situation, such that, when said plates are in said nipping situation, said pair of plates approach each other to nip said plurality of photographs inserted therebetween from both sides, and when in said insertable situation, said pair of plates are separated to hold gently said plurality of photographs inserted therebetween in upright states;

photograph receiving means for supporting lower ends and one side edge of said plurality of photographs in an inclined state so that said plurality of photographs inserted therebetween are not dropped when said nipping means are in said insertable situation;

vibration means for vibrating said photograph receiving means, when said photograph nipping means are in said insertable situation, in order to straighten the lower ends and one side edges of said plurality of photographs;

actuator means for setting said photograph nipping means in said insertable situation when said plurality of photographs are inserted, and for setting said photograph nipping means in said nipping situation after said plurality of photographs are straightened by said vibration means; and bonding means for bonding the lower ends of said plurality of photographs nipped by said photograph nipping means onto an adhesive layer of a cover sheet, said cover sheet serving as a front cover portion, a rear cover portion and a back cover portion.

2. The apparatus as claimed in claim 1, wherein said photograph nipping means comprises means for moving said plates between a first position, located above said photograph receiving means, and a second position, located above said bonding means.

3. The apparatus as claimed in claim 2, wherein one of said pair of nipping plates is a base nipping plate and the other is a movable plate movably mounted on said base nipping plate for movement in parallel relation.

4. The apparatus as claimed in claim 3, wherein said actuator means comprises urging means for urging said movable nipping plate toward said base nipping plate, a cam for pushing said movable nipping plate against said urging means in order to displace said movable nipping plate from said insertable situation to said nipping situation, and an operating lever for rotating said cam.

5. The apparatus as claimed in claim 4, wherein said photograph receiving means comprises a bottom plate which contacts said lower ends of said plurality of photographs, a front plate which contacts said one side edge of said photographs, and a mounting plate integrally formed with one of said bottom plate and one side edge of said front plate.

6. The apparatus as claimed in claim 5, wherein said vibration means comprises a motor mounted on said mounting plate, and an eccentric member eccentrically mounted on a shaft of said motor and adapted to apply vibration to said motor owing to rotation of said eccentric number.

7. The apparatus as claimed in claim 6, which further includes a lock lever coaxial with said cam, said lock lever being engaged with a fixed pin to lock said photograph nipping plates in said first position, so that said photograph nipping plates are not moved toward said second position when said movable nipping plate is in said insertable situation.

8. The apparatus as claimed in claim 7, wherein said bonding means includes:

a stage for placing said cover sheet thereon;

an opening formed in a portion of said stage where said adhesive layer of said cover sheet is located;

a pressure roller movable along said opening, said roller being adapted to press said cover sheet from the back thereof in order to bond said adhesive layer to the lower ends of said plurality of photographs; and roller shifting means for shifting said pressure roller.

9. The apparatus as claimed in claim 8, wherein said roller shifting means includes:

a link having an upper arm and a lower arm, said upper arm being provided with said pressure roller rotatably mounted on an upper end thereof, a lower end of said lower arm being rotatably mounted on a frame;

a spring disposed between an upper arm and a lower arm of said link and adapted to urge said upper and lower arms so that they are brought to be in alignment with each other; and a second operating lever for rotating said lower arm.

10. The apparatus of claim 9, which further includes a cover sheet bending block, said cover sheet bending block being formed with a V-shaped groove in section in order to bend said cover sheet having said plurality of photographs attached thereon along said plurality of photographs to form a channel shape.

11. The apparatus as claimed in claim 10, wherein said block comprises a triangular-shaped pole.

12. An apparatus for making a booklet or album, said apparatus comprising:

a stage on which a cover sheet having a strip-shaped adhesive layer is placed, said stage having an opening larger than said adhesive layer, said opening being formed in a position where said adhesive layer is located;

nipping means, having a pair of plates and being displaceable between an insertable situation and a nipping situation, for nipping a plurality of photographs, said nipping means, when in said insertable situation, permitting said plurality of photographs to be inserted into said pair of plates, and when in said nipping situation, nipping said plurality of photographs from both sides thereof with lower ends of said plurality of photographs protruding downwardly below the lower ends of said plates;

movement means for moving said photograph nipping means between a loading position, where said plurality of photographs are loaded, and a bonding position disposed above said opening;

means for receiving the lower ends and one side edge of said plurality of photographs so that said plurality of photographs, when inserted, are not dropped when said nipping means is in said bonding position; and a pressure roller movable along said opening in a projected state from said opening, said roller, when said photograph nipping means is in the bonding position, pressing said cover sheet from a back thereof in order to bond said adhesive layer to the lower ends of said plurality of photographs.

13. The apparatus as claimed in claim 12, further comprising vibration means for vibrating said photograph receiving means in order to straighten said plurality of photographs.

* * * * *